United States Patent [19]

Vandas

[11] 4,066,064

[45] Jan. 3, 1978

[54] KITCHEN VENTILATOR DAMPER ACTUATOR AND CONTROL

[75] Inventor: Edward B. Vandas, St. Louis, Mo.

[73] Assignee: McGraw-Edison Company, Elgin, Ill.

[21] Appl. No.: 674,816

[22] Filed: Apr. 8, 1976

[51] Int. Cl.[2] ..... F23L 13/00

[52] U.S. Cl. ..... 126/299 E; 169/65; 251/62; 55/DIG. 36

[58] Field of Search ..... 126/299 R, 299 A, 299 B, 126/299 D, 299 E; 251/62, 298; 55/210, 212, DIG. 36; 98/115 K; 169/60, 61, 65

[56] References Cited

U.S. PATENT DOCUMENTS

| | | | |
|---|---|---|---|
| 2,311,374 | 2/1943 | Farmer et al. | 169/2 |
| 2,648,346 | 8/1953 | Deardorff et al. | 251/62 |
| 3,055,285 | 9/1962 | Gaylord | 98/115 K |
| 3,207,058 | 9/1965 | Gaylord | 98/115 K |
| 3,785,124 | 1/1974 | Gaylord | 98/115 K |
| 3,802,493 | 4/1974 | Goettl | 165/60 |
| 3,805,685 | 4/1974 | Carns | 126/299 E |
| 3,831,643 | 8/1974 | Lau | 251/298 |

*Primary Examiner*—Ronald C. Capossela

*Attorney, Agent, or Firm*—Charles F. Lind

[57] ABSTRACT

This invention relates to a kitchen ventilating system, where a kitchen hood communicates through an exhaust duct to the exterior atmosphere, where a fan in the duct operates for powered venting of the kitchen, and where a damper can be closed to separate the kitchen from the exhaust duct. This invention teaches means for shifting the damper between the closed position and the open position, which means is a fluid power actuator in the form of a power cylinder. The power cylinder is operated by water, typically from the same source as the regular kitchen water, and control valve means utilized between this source of water under pressure and the cylinder controls the shifting of the damper. The preferred system provides that the valve means shifts by spring pressure to the position corresponding to where the damper is closed and is electrically shifted to open the damper, so that should a power failure occur the damper will automatically be closed. Also, there is a pressure tank that retains sufficient water pressure to close the damper, even though the source of water may actually have inadequate or total loss of pressure.

14 Claims, 4 Drawing Figures

KITCHEN VENTILATOR DAMPER ACTUATOR AND CONTROL

BACKGROUND OF INVENTION

In commercial restaurants and institutional cooking places, it is common to have a powered venting or exhaust system to remove the cooking fumes from the kitchen for discharge through an exhaust duct to the outside atmosphere. A vent hood is typically located in the kitchen overlying a particular cooking appliance, such as a deep fat fryer, range, or griddle, and communicates with the exhaust duct which typically in turn rises upwardly from the hood through the building wall or roof at an elevation higher than the hood. A fan or blower in the duct work provides a negative pressure for forced ventilation of the kitchen air through the exhaust system, but because of the differential in elevation, even when the fan is not operating there nonetheless is a marked chimney effect created through the duct work.

A typical hazard of a commercial kitchen is the possibility of a fire, because of the collection of grease and other inflammable substances and the ever present heat and even open flames of the kitchen. Further, the exhaust duct system becomes a fire risk after continued use, without proper cleaning, because of the buildup of grease on the inside of the duct work. Accordingly, it is generally imperative that the ventilating system have a damper that can be closed to block the free "chimney" effect passage of air from the kitchen through the duct work to the atmosphere, and that appropriate controls deenergize the ventilator power fan unit. These precautions are necessary to preclude the possible spreading of a kitchen fire to other locations and in many respects, are required to achieve an acceptable fire rating under various testing laboratories such as the Underwriters' Laboratories, or of the National Sanitation Foundation, or under various building codes of the local area, city, or state.

One system thus far employed in automatic fire rated ventilators might include, for example, a damper which is normally closed by a spring and which is held open by a fusible link. Consequently, upon the link being melted by the heat of a proximate fire, the damper is slammed shut to block the exhaust vent passage. The difficulty in the continued use of such a system is that the damper is seldom opened and closed. Consequently, it can become bound by the buildup of grease or other dirt in the bearings or the spring can lose its snap because of heat or age, to the end that even with the fusible link removed the damper may not properly close. However, even if the damper did close successfully during a fire and even if no major damage occurred in the venting system, the damper safety device would not be workable until the damper was manually opened and a replacement fusible link put in place.

Another type of safety control that is used commonly to automatically trip the damper in the event of a fire is electrically operated. Under such circumstances, a fire sensing means triggers an electric signal to a solenoid which either releases the damper to allow the same to be mechanically shifted to its closed position or that actually electrically shifts the damper to its closed position. In any regard, a problem with this type control is that frequently the electric power to the facility is interrupted during a fire to render the electrically actuated safety damper unusuable thereafter. Furthermore, even though the damper might successfully be closed by the electrically actuated controls, nonetheless it must generally thereafter be manually opened after the fire is put out. Further, unless such an electrically actuated system is tested for operational certainty on a regular basis, again after periods of nonuse the same may or may not be in proper working condition; and the unsuspected user may not be the wiser until after the fact and the fire was allowed to burn without the damper properly closing.

Various patents which illustrate the systems noted above are as follows: Gaylord U.S. Pat. No. 2,813,477; Graswich et al. U.S. Pat. No. 2,961,941; Gaylord U.S. Pat. No. 3,055,285; Gaylord U.S. Pat. No. 3,207,058; Gaylord U.S. Pat. No. 3,247,776; Gaylord U.S. Pat. No. 3,611,909; Gaylord U.S. Pat. No. 3,785,124.

SUMMARY OF THE INVENTION

This invention teaches a kitchen ventilating system which is fire rated, and provides a damper that is shifted between its open and closed positions in a fail safe and mechanically positive manner without the use of a closing spring and even after total loss of both electrical power and water pressure. Specifically, a fluid pressure actuator in the form of a power cylinder is operated by water, typically from a pressure source convenient to and a part of the kitchen itself, to shift the damper between its operative positions. Further, the control valve is electrically energized to open the damper and is spring shifted to the position that closes the damper, to make the damper device close in a fail safe manner even in the event electrical power is lost during a fire. The actuating water control circuit further has a reservoir of pressure and a back flow check device to provide that the damper will close even in the event that all pressure of the water source is lost. The control further allows for powered opening of the closed damper, responsive to a manually activated electrical input signal. The control further, most importantly, operates automatically to open and close the damper every time that the exhaust blower or fan is turned on and off, typically on a daily basis, so that the operator is appraised regularly that the damper system is workable at that precise time.

The subject device further has automatic timing means for operating a wash cycle every time the exhaust blower is deenergized, and water discharge, with a detergent if desired, from pipes located within the exhaust duct system flushes the interior of the grease extractor section.

By using only the water pressure available in the building for actuating the cylinder, there typically is sufficient mechanical forces to close or open the damper, and with a positive mechanical force is moving the damper to both positions. Further, the system can operate without the need of electrical wires or controls actually in or on the unit, other than for the thermostat itself, since it only requires water line connections between the power cylinder and the source of water pressure and the drain. The hydraulic fluid actuator probably in operation will have a longer life, greater reliability, and yet be more economical to install and operate than the typical prior art damper actuating mechanisms incorporating mechanical springs, control solenoids, and microswitches.

DETAILED DESCRIPTION OF THE INVENTION

Figure 1:
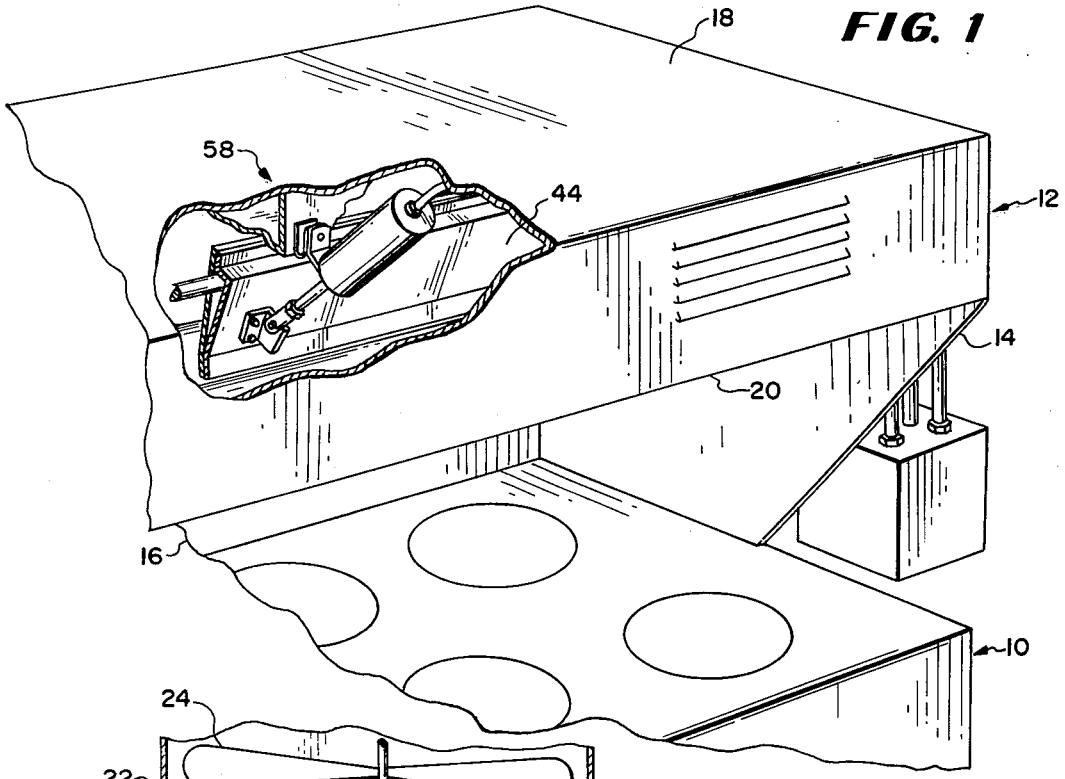
FIG. 1 is a perspective view of ventilating apparatus shown in typical operative association with a kitchen cooking appliance, where the improved damper actuating means is incorporated in the apparatus.

FIG. 1 shows a kitchen cooking appliance in the form of a range 10, and a hood 12 is vertically spaced above and in general overlying relationship thereto. The hood 12 has opposed side walls 14 (only one being shown) and a rear wall 16 upstanding from general proximity of the cooking appliance and terminating at a top wall 18. A front wall 20 downwardly depends from top wall 18 and interconnects the opposed side walls 14 to form an inverted cuplike structure, as is well known. An exhaust duct 22 communicates upwardly from an opening in the top wall 18 of the hood and is adapted to pass through the building structure, such as the walls or the roof, to discharge ultimately into the outside atmosphere. A fan unit or blower 24 is generally mounted in the exhaust duct passage, frequently at a discharge plenum located on the roof or in a wall opening, but the same is illustrated in the duct itself in a semi-schematic manner. A motor 26 powers the fan 24 which creates a negative pressure in the duct to induce forced ventilation of kitchen air and fumes through the vent inlet 28 and out the exhaust duct 22.

There further is typically associated with the vent structure a means for removing grease from the air to minimize the grease build-up in the exhaust duct 22 and further frequently to satisfy local building codes. The type illustrated herein is commonly known as a centrifugal grease extractor where the air has a relatively uninterrupted but tortuous path between the vent inlet 28 and the exhaust duct. The illustrated grease extractor has a front wall 30 above the inlet 28 previously noted, an inclined bottom portion located below the inlet and comprises of an outer wall 32 and inner walls 34 and 35, a vertical rear wall 36, and top baffle wall having a forward portion 38 that extends rearwardly from front wall 30 in general parallel relationship to the inner wall portion 34 and an inclined rear portion 40 that ends at a trough 41 spaced above the inner wall portion 34 forwardly of the rear wall 36. Additionally, an intermediate baffle 42 upstands from the inner wall portion 34, and a damper 44 pivoted at pin 46, when opened, presents a lower edge 47 spaced forwardly of the intermediate baffle 42 and above the inner wall portion 34. This particular grease extractor construction is disclosed and claimed in copending patent application entitled "Kitchen Ventilator Grease Extractor Construction" which was filed on Apr. 12, 1976 and has Ser. No. 675,965, now U.S. Pat No. 4,022,118.

The air drawn into the inlet 28 is forced to curve, as generally shown by line 48, down around the lower edge 47 of the damper and then up over baffle 42 and then down around the inclined rear portion to of the top baffle and up again along rear wall 36. At each turn, the heavier grease particles are thrown from the air and are collected against the various baffles and ultimately drain to the inner walls 34 and 35. A drain pipe 49 connected to the lowest area of these walls is used to carry away the collected grease to a point of discharge remote from the extractor unit.

The wash system shown has an inlet water pipe 50 extended into extractor plenum area 51 above the top baffle wall portions 38 and 40 and adjacent one of the side walls 14, and downwardly through an opening in the forward portion 38 and then crosswise of the inlet air flow. A plurality of nozzles 52 are located along the pipe suited for discharging high pressure water, with or without detergent, into the plenum for high velocity discharge against the walls thereof to remove the grease and dirt built up on the walls and flush the same down the drain pipe 49. The particular location of the grease extraction means is more completely covered in U.S. Pat. No. 4,022,118, but it is generally envisioned that any wash system having sufficient coverage and pressure to generally blanket the interior walls of the extractor plenum and baffles would suffice. The work system further serves as a means for minimizing the chances of a fire spread through the duct system and thereby satisfies many safety code requirements for such equipment.

Figure 2:
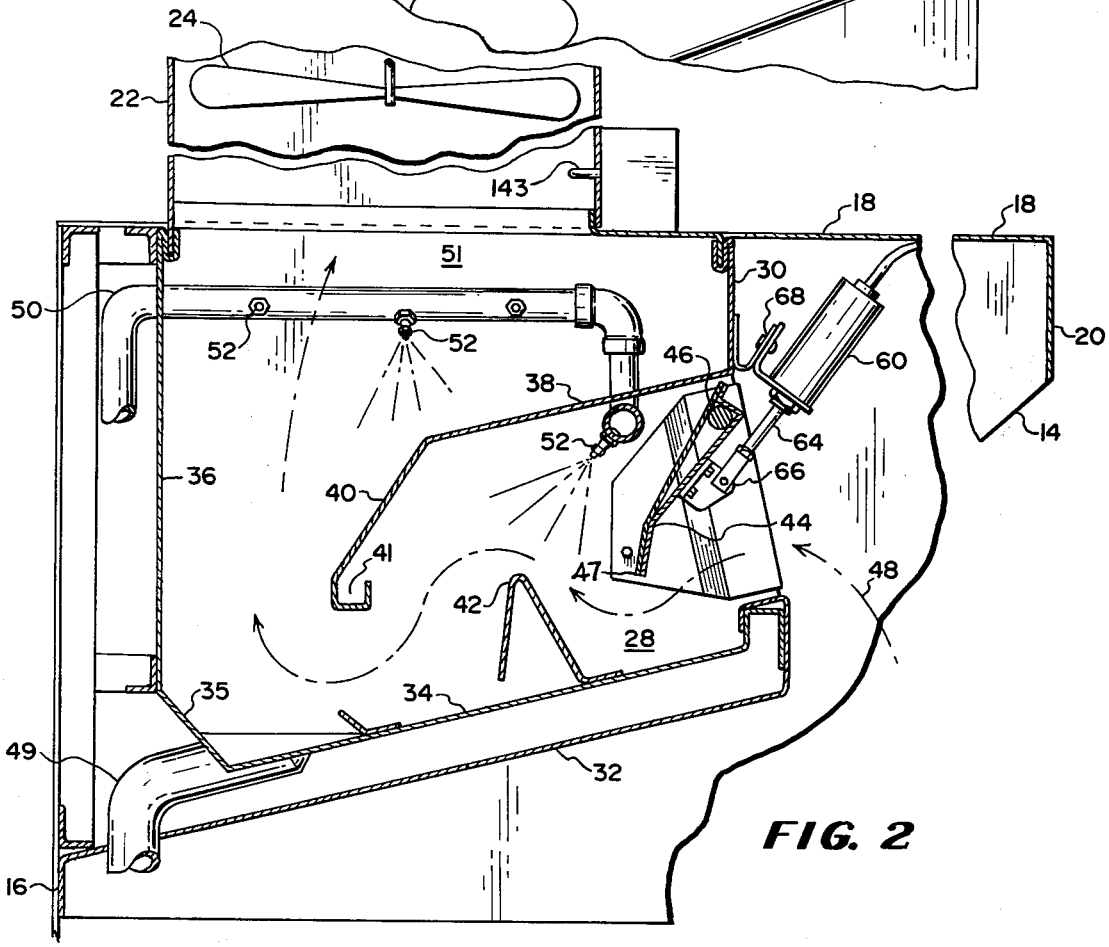
FIG. 2 is a sectional view of the hood showing the specific exhaust flow path from the kitchen through a grease extractor section to the exhaust duct, and the damper and actuating means therefor.

As noted, there is provided at the inlet of the extraction unit a damper 44 which is pivoted about pin 46, and the damper can be shifted between two operative positions, namely the open position illustrated in FIG. 2 allowing the passage of air through the inlet, and the closed position where the damper lies across and closes the inlet to preclude the passage of air through the vent. The particular mounting means and construction of the damper 44 is more thoroughly covered in my copending application entitled "Kitchen Ventilator Damper Construction" which was filed Dec. 8, 1975, having Ser. no. 638,502 now U.S. Pat. No. 4.029,002.

The particular mechanical means 58 for moving the damper 44 between the open and closed positions is illustrated in FIGS. 1 and 2, and includes a fluid power actuator in the form of a power cylinder 60. The power cylinder has an interior piston 62 (illustrated in schematic in FIG. 3) connected by rod 64 to a yoke 66, which in turn is pivoted to a bracket secured to the front face of the damper 44. The power cylinder itself is connected to a bracket 68 which in turn is mounted on the front wall 30 of the extractor section. When the power cylinder means is extended (as illustrated in FIG. 2) the damper is in the open position; whereas when the power cylinder is retracted the damper is closed.

Figure 3:
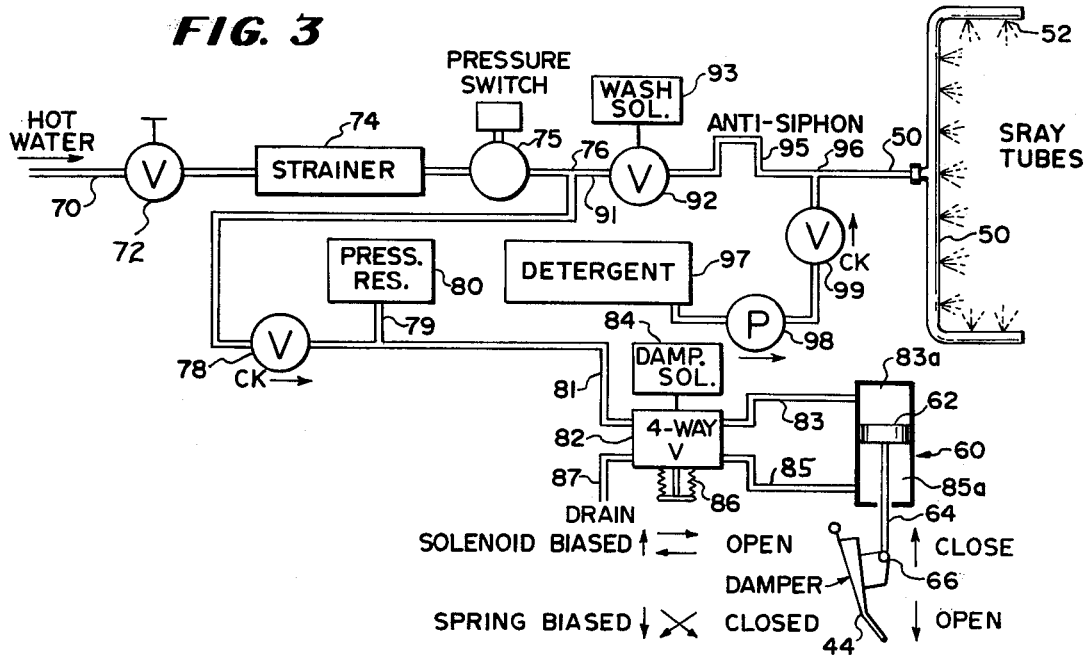
FIG. 3 is a water flow schematic for the water wash and damper actuation control used in the subject apparatus.

FIG. 3 shows a preferred manner of connection of the fluid actuator for control and operation of the same.

A hot water inlet line 70 connects through a valve 72, a strainer 74, and a pressure switch 75, to a tee 76, where one leg of the tee connects through a one-way check valve 78 to a tee leading off in line 79 to a pressure reservoir 80 and in the line 81 as inlet line to a four-way valve 82. Two lines 83 and 85 extend also from the output side of the valve and connect to the opposite end chambers **83*a* and 85*a* of the power cylinder 60. The valve is normally biased by spring 86 to the closed position (as shown in schematic representation in FIG. 3) where a direct connection is created from line 81 through the valve to line 85 and end chamber 85*a* of the power cylinder causing the expanding end chamber 85*a* to close the damper; whereas the opposite contracting end chamber 83*a* of the cylinder is vented by line 83 through the valve to a drain line 87 as shown. The valve is shifted by energizing a solenoid 84, whereupon the inlet line 81 connects through the valve to line 83 and end chamber 83***a* for expanding such end chamber to open the damper; whereas end chamber 85*a* is then vented by line 85 through the four-way valve 82 to drain line 87.

The valve 82 thus has two operative positions that respectively interconnect two pairs of ports, each pair consisting of an infeed port and an outfeed port. Concerning the first pair of infeed and outfeed ports, the infeed port is connected by line 81 to the source of fluid and the outfeed port is connected by line 87 to the drain. The second pair of infeed and outfeed ports is connected by lines 83 and 85 to the opposite end chambers of the power cylinder 60. It should be noted that the direction of fluid flow through the second mentioned pair of infeed and outfeed ports is reversed as the valve is shifted between its opposite operative positions, so that the respective ports of the second mentioned pair of ports alternately act as infeed and outfeed ports.

The pressure reservoir 80, previously referred to, is an inverted tank having a small inlet line 79. Water pressure generated in the line 79 causes some water to flow into the tank until the pressure is balanced by the compression of the air trapped at the top of the tank, at which time the air remains confined at the top of the tank and water is at the lower section of the tank. With the check valve 78, should there be a drop in pressure of the inlet supply of the water at line 70, the reserve pressure and water remain in the pressure reservoir 80. The reserve pressure and volume of the water in the tank is sufficient, should there be a need for it and upon the shifting of the four-way valve 82, to force water through the appropriate connections to actuate the power cylinder 60 and shift the damper. Thus, even in the event of a water pressure failure, such as someone closing and inadvertantly leaving closed a water valve, the system would yet operate to close the damper should a fire occur in the building.

The hot water line 91 from the tee 76 connects through a wash valve 92 controlled by wash solenoid 93, an anti-siphon vacuum breaker 95 in the system, and through a tee 96 to the hot water spray pipe 50 for discharging as previously noted from the discharge nozzles 52. A tank 97 of detergent further is provided which connects through a pump 98 and a one-way check valve 99 to the tee 96 for admission of detergent into the hot water spray system for thorough removal of any dirt or grease from the plenum walls.

It can be seen that the control illustrated in FIG. 3 provides for both opening and closing the damper with a positive mechanical force of the cylinder 60 even though it is accomplished solely by the provision of water pressure of the type readily available in a commercial building. The illustrated valve 82 is electrically actuated to one position and spring returned to the other position, and the connection is made so that should there be a loss of electrical power, the damper would nonetheless remain in or be shifted to the closed position, since the spring biased valve would connect the high pressure water line 81 to the end chamber 85*a* of the power cylinder means 60.

Figure 4:
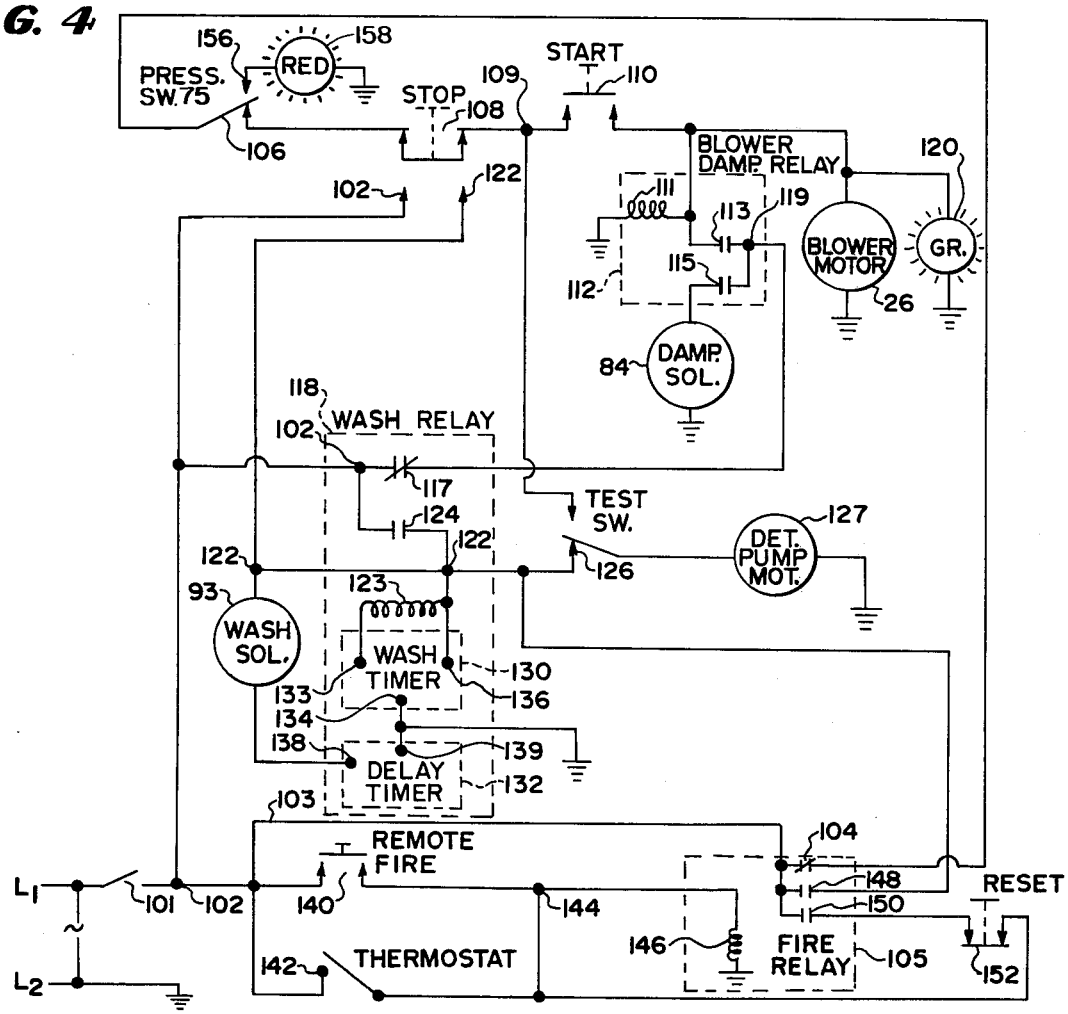
FIG. 4 is an electrical schematic for the water wash and damper actuator control used in the subject apparatus.

FIG. 4 illustrates a control which is preferred for versatile use of the invention as thus far disclosed. There is illustrated a typical alternating current power source across lines L1 and L2, where for simplicity sake L2 is shown as grounded and L1 is the operating hot line. As illustrated, L1 connects through a main on-off switch 101 to common hot terminal 102. Under normal use of the invention, the blower or fan motor 26 is operated for powered ventilation, as well as the damper solenoid is energized to provide that the damper is open.

To start an operating cycle, the power at hot terminal 102 is normally connected via line 103 across normally closed contacts 104 of a fire relay 105, across the closed contacts 106 of water pressure switch 75, and across normally closed contacts of a stop switch 108 to terminal 109. Upon momentary closing of a manual start switch 110, the closed contacts complete a circuit from the hot terminal 109 through coil 111 of a damper and blower relay 112 to energize the relay and further close the normally open contacts 113 and 115 of the relay. The coil 111 remains energized by the circuit from the hot terminal 102 across the normally closed contacts 117 of wash relay 118 to terminal 119 and across the now closed relay contacts 113.

With blower and damper relay 112 energized, the blower motor 26 likewise is energized by the circuit across closed contacts 113 from the hot terminal 119, as well as is a green indicator light 120 connected in parallel circuit with the blower to indicate by visual means that the blower is energized. Power is also connected from hot terminal 119 across the now closed contacts 115 to the damper solenoid 84 to shift the four-way valve 82 to open the damper as previously noted.

The ventilation device would normally operate in this fashion, with the damper open and the blower or fan operating, to extract fumes from the kitchen in the customary manner. At the end of the work day when the operating kitchen appliances are to be turned off, the operator need only momentarily shift the stop switch 108, at which time power from the hot terminal 102 is connected across the other contacts of the stop switch through terminal 122 to coil 123 of the wash relay 118 to energize the relay. The wash relay upon being energized opens the normally closed contacts 117 to interrupt power to terminal 119 to deenergize the blower and damper relay 112, which stops the blower and allows shifting of the four-way valve 82 to close the damper; and further closed normally open contacts 124 of the relay. The closed wash relay contacts 124 deliver power from hot terminal 102 to maintain coil 123 energized, and also delivers power to wash solenoid 93 and across normally closed contacts 126 of a test switch to motor 127 for operating detergent pump 98 to effect a wash cycle.

The wash relay 118 as herein preferably designed remains energized for a timed duration of 3 to 6 minutes, for example, during which time water and detergent discharged from the spray nozzles as above noted completes a wash cycle. However, it is desirable to provide a slight delay of approximately 5–10 seconds before opening the wash valve 92, in order to allow the blower to physically stop and the damper to physically close.

A control suited for effecting this is illustrated in a schematic form in FIG. 4 where wash duration timer 130 and wash delay timer 132 are in the circuit between terminal 122 and the ground potential. The wash duration timer 130 is energized with the relay coil 123 and operates to maintain the coil energized for the set duration of the wash cycle, for example, for a 5-minute time span. The internal connection within itself between terminals 133 and 134 thus would complete and hold the circuit from the relay coil 123 to the ground potential. However, after the lapsed set time as is determined in the circuit across terminals 136 and 134, the internal connection across terminals 133 and 134 would break to deenergize the relay coil 123 and in turn the relay 118.

The power at terminal 122 renders the one side of the wash solenoid 93 hot, and this is conncted through the solenoid across terminals 138 and 139 of the delay timer 132 to ground. The delay timer allows only a trinkle flow of current across the terminals 138 and 139, enough to actuate the timer but not enough to energize the wash solenoid 93. However, after the lapse of time of the delay, a circuit is completed across the terminals 138 and 139 which is sufficient to energize the wash solenoid and maintain the same energized until the wash timer 130 times out. Upon the lapse of time determined by the wash timer 130, the coil 123 becomes deenergized to open the timer contacts 124, and this deenergizes the wash solenoid 93 and detergent pump motor 127 and terminates the wash cycle.

Suitable timers 130 and 132 for performing the above are available from SSAC Precision Products Incorporated of Liverpool, NY, under model numbers TS 2424 and TS 1422, respectively.

It might be noted that the detergent pump can be tested at any time for checking its proper functioning or for the presence of detergent in the system by shifting the test switch against the opposite contact which completes a circuit from the terminal 109, which normally is hot when the switch 101 is closed.

It is further noted that a wash cycle is automatically started and operated for a set duration every time that the operator shifts the stop switch 108 from its normal position as shown. During the wash cycle, damper 44 should be closed to provide visual assurance to the operator that the damper controls are properly working.

After the wash timer 130 has lapsed and the wash cycle has concluded, the timer contacts 117 once again close and allow for the terminal 119 to be hot and this thereby readies the apparatus for a normal operating cycle where the blower would be working and the damper would be open; and this cycle is started by momentarily closing the contacts of start switch 110. However, until such time and after the wash cycle has been started and completed, the disclosed control automatically leaves the damper in its closed position to preclude the transfer of air into or from the building through the vent inlet 28. This provides for certain savings of heating energy, particularly during the cooler months by stopping the chimmey effect that otherwise occurs where the kitchen ventilating system is normally maintained opened even when it is not in use.

As above noted, another main purpose of this particular invention is to provide for improved operational characteristics in the event of a fire. Under such circumstances, the detection of a fire should automatically close the damper, stop the exhaust fan or blower, and discharge fire quenching water into the duct system.

As illustrated in FIG. 4, there are two ways to instigate a fire cycle; one being manual actuation of a fire switch 140 and the other being automatically upon sensing of excess heat by a thermostat 142. The switch 140 and thermostat 142 are in a parallel circuit between hot terminal 102 and relay coil 146 of the fire relay 105. Normally, the thermostat would have contacts that are open and closed only in the event of sensing a heat which is indicative of the presence of a fire. The thermostat might be located physically in the exhaust duct 22 as is evidenced by the projecting terminal 143.

Upon the fire relay coil 146 being energized the normally open contacts 148 and 150 are closed, and contacts 104 are opened. The closed contacts 150 complete through normally closed contacts 152 of a manual reset switch a holding circuit from hot terminal 102 and through terminal 144 with the coil 146 to maintain the relay energized until the manual reset switch is depressed and the contact 152 are opened. The closed contacts 148 completes a circuit from the hot terminal 102 to the wash relay coil 123 which instigates a wash cycle, as previously noted. This terminates power to the terminal 119 upon opening the normally closed contacts 117, to close the damper and stop the blower, and further causes the discharge of water under pressure from the nozzles 52 into the interior of the grease extractor and plenum. This water discharge will continue as long as the fire relay 105 remains energized, the wash solenoid 93 being energized across the closed contacts 148 and through the energized delayed timer 132 across terminals 138, 139. The opened contacts 104 make the start terminal 109 neutral, so that, the blower cannot be started and the damper cannot be opened by closing the contacts of the start switch 110. The fire relay remains energized until it is manually released by momentarily opening the contacts 152 of the reset switch.

As previously noted, a major advantage of the disclosed invention is the fact that the damper is automatically closed by means completely independent of mechanical or electrical energy, and relies solely on water pressure within a water system in the building itself or within the pressure reservoir 80 previously noted. Moreover, the damper mechanism and control operates on a regular basis every time the ventilator blower is started and stopped, so that there is little chance for an operator to be deceived into believing the fire detection mechanism is operable where in fact it is not, since the same is visually checked every day.

It is noted that the water pressure switch contacts 106 will open upon an insufficient pressure at the sensed location of the device 75 in the line, and further will shift against terminal 156 to illuminate a red indicator light 158. Under such low water pressure sensed conditions, terminal 109 is neutral and a new operating cycle cannot be started to start the blower or open the damper; however, an operating cycle will continue as long as terminal 119 remains hot.

I claim:

1. In a kitchen venting system having an exhaust duct and power fan means therein, and structure defining a passage between the kitchen and the exhaust duct whereby kitchen fumes are vented through the passage upon operation of the fan means, the improvement comprising the combination of a damper, means supporting the damper to shift between a closed position blocking the passage and an opened position allowing flow through the passage, a fluid power actuator having first and second members that move relative to one another upon the extension and retraction of the power actuator, means securing the first and second members of the power actuator between said structure and damper to provide that extension and retraction of the power acutuator respectively shifts the damper between and to said positions, a source of fluid under pressure, a control valve between said source and the power actuator operable to pressurize and exhaust the latter to control the extension and retraction thereof, said control valve being four-way having two operative positions that respectively interconnect two pairs of ports each consisting of an infeed port and an outfeed port, and one pair of infeed and outfeed ports being connected to opposite operative sides of the power actuator and the opposite pair of infeed and outfeed ports being connected to the source of fluid and to a drain, operable to have powered operation for both the extension and retraction of the power actuator and the resulting shifting of the damper.

2. A kitchen venting system combination according to claim 1, further including a pressure reservoir, a tee connecting the pressure reservoir to both the source of fluid and to the control valve, said pressure reservoir having sufficient storage capacity of fluid and pressure to operate the power actuator to shift the damper to the closed position even in the event of loss of pressure of the source upstream of the tee, and flow check means precluding discharge from the pressure reservoir other than toward the power actuator.

3. A kitchen venting system combination according to claim 2, further including means for biasing said control valve normally to the operative position that tends to shift the damper to the closed position, and electrical means to shift the control valve to the other operative position, whereby any loss of electrical power automatically causes the damper to be shifted to the closed position.

4. In a kitchen venting system having an exhaust duct and power fan means therein, and structure defining a passage between the kitchen and the exhaust duct whereby kitchen fumes are vented through the passage upon operation of the fan means, the improvement comprising the combination of a damper, means supporting the damper to shift between a closed position blocking the passage and an opened position allowing flow through the passage, a fluid power actuator having first and second members that move relative to one another upon the extension and retraction of the power actuator, means securing the first and second members of the power actuator between said structure and damper to provide that extension and retraction of the power actuator respectively shifts the damper between and to said positions, a source of fluid under pressure, a control valve between said source and the power actuator operable to pressurize and exhaust the latter to control the extension and retraction thereof, spray means to discharge water into the exhaust duct, control means to start a water discharge cycle, a timer responsive to the start of the water discharge cycle operable to delay for a few seconds the actual discharge of water from the spray means, and the control means further including means to shift the control valve without delay responsive to the start of the water discharge cycle effective to have the damper closed prior to the water discharge.

5. In a kitchen venting system having an exhaust duct and power fan means therein, and structure defining a passage between the kitchen and the exhaust duct whereby kitchen fumes are vented through the passage upon operation of the fan means, the improvement comprising the combination of a damper, means supporting the damper to shift between a closed position blocking the passage and an opened position allowing flow through the passage, a fluid power actuator having first and second members that move relative to one another upon the extension and retraction of the power actuator, means securing the first and second members of the power actuator between said structure and damper to provide that extension and retraction of the power actuator respectively shifts the damper between and to said positions, ε source of fluid under pressure, a control valve between said source and the power actuator operable to pressurize and exhaust the latter to control the extension and retraction thereof, spray means to discharge water into the exhaust duct, said fluid for the power actuator being water, and said source of water for the power actuator being the same as is for the water discharge from the spray means.

6. A kitchen venting system combination according to claim 5 further including a control to start a water discharge cycle from the spray means, means in the control operable to delay for a few seconds actual discharge of water from the spray means even after the start of the water discharge cycle, and the control further including means to shift the control valve without delay responsive to the start of the water discharge cycle effective to close the damper prior to the water discharge from the spray means.

7. In a kitchen venting system having an exhaust duct and power fan means therein, and structure defining a passage between the kitchen and the exhaust duct whereby kitchen fumes are vented through the passage upon operation of the fan means, the improvement comprising the combination of a damper, means supporting the damper to shift between a closed position blocking the passage and an opened position allowing flow through the passage, a fluid power actuator having first and second members that move relative to one another upon the extension and retraction of the power actuator, means securing the first and second members of the power actuator between said structure and damper to provide that extension and retraction of the power actuator respectively shifts the damper between and to said positions, a source of fluid under pressure, a control valve between said source and the power actuator operable to pressurize and exhaust the latter to control the extension and retraction thereof, a pressure reservoir, a tee connecting the pressure reservoir to both the source of fluid and to the control valve, said pressure reservoir having sufficient storage capacity of fluid and pressure to operate the power actuator to shift the damper to the closed position even in the event of loss of pressure of the source upstream of the tee, and flow check means precluding discharge from the pressure reservoir other than toward the power actuator.

8. In a kitchen venting system having an exhaust duct and power fan means therein, and structure defining a passage between the kitchen and the exhaust duct whereby kitchen fumes are vented through the passage upon operation of the fan means, the improvement comprising the combination of a damper, means supporting the damper to shift between a closed position blocking the passage and an opened position allowing flow through the passage, a fluid power actuator having first and second members that move relative to one another upon the extension and retraction of the power actuator, means securing the first and second members of the power actuator between said structure and damper to provide that extension and retraction of the power actuator respectively shifts the damper between and to said positions, a source of fluid under pressure, a control valve between said source and the power actuator operable to pressurize and exhaust the latter to control the extension and retraction thereof, said control valve being four-way having two operative positions that respectively interconnect two pairs of ports each consisting of an infeed port and an outfeed port, one pair of infeed and outfeed ports being connected to opposite operative sides of the power actuator and the opposite pair of infeed and outfeed ports being connected to the source of fluid and to a drain, operable to have powered operation for both the extension and retraction of the power actuator and the resulting shifting of the damper, means for biasing said control valve normally to the operative position that tends to shift the damper to the closed position, and electrical means to shift the control valve to the other operative position, whereby any loss of electrical power automatically causes the damper to be shifted to the closed position.

9. In a kitchen venting system having an exhaust duct and power fan means therein, and structure defining a passage between the kitchen and the exhaust duct whereby kitchen fumes are vented through the passage upon operation of the fan means, the improvement comprising the combination of a damper, means supporting the damper to shift between a closed position blocking the passage and an opened position allowing flow through the passage, a fluid power actuator having first and second members that move relative to one another upon the extension and retraction of the power actuator between said structure and damper to provide that extension and retraction of the power actuator respectively shifts the damper between and to said positions, a source of fluid under pressure, a control valve between said source and the power actuator operable to pressurize and exhaust the latter to control the extension and retraction thereof, a pressure reservoir, a tee connecting the pressure reservoir to both the source of fluid and to the control valve, said pressure reservoir having sufficient storage capacity of fluid and pressure to operate the power actuator to shift the damper to the closed position even in the event of loss of pressure of the source upstream of the tee, flow check means precluding discharge from the pressure reservoir other than toward the power actuator, means for biasing said control valve normally to the operative position that tends to shift the damper to the closed position, and electrical means to shift the control valve to the other operative position, whereby any loss of electrical power automatically causes the damper to be shifted to the closed position.

10. In a kitchen venting system having an exhaust duct and power fan means therein, structure defining a passage between the kitchen and the exhaust duct whereby kitchen fumes are vented through the passage upon operation of the fan means, and electrical power on-off control means for operating the fan means, the improvement comprising the combination of a damper, means supporting the damper to shift between a closed position blocking the passage and an opened position allowing flow through the passage, a fluid power actuator having first and second members that move relative to one another upon the extension and retraction of the power actuator, means securing the first and second members of the power actuator between said structure and damper to provide that extension and retraction of the power actuator respectively shifts the damper between and to said positions, a source of fluid under pressure, a control valve between said source and the power actuator operable to pressurize and exhaust the latter to control the extension and retraction thereof, means for biasing said control valve normally to the operative position that tends to shift the damper to the closed position, and electrical means including the on-off control means operable to shift the control valve to the other operative position, whereby manual actuation of the on-off control means to power the fan means also automatically causes the damper to be shifted to the opened position, and whereby manual actuation of the on-off control means to stop the fan means and including otherwise the loss of electrical power at the on-off control means automatically causes the damper to be shifted to the closed position.

11. A kitchen venting system combinaton according to claim 10, further including spray means to discharge water into the exhaust duct, a source of water under pressure, a control valve between the source of water and the spray means, and means to open the control valve to spray water automatically responsive to the manual actuation of the on-off control means to stop the fan means.

12. A kitchen venting system combination according to claim 11, further providing that the fluid used to power the power actuator is water and the source thereof is the same source as for the water spray means.

13. In a kitchen venting system having an exhaust duct and power fan means therein, and structure defining a passage between the kitchen and the exhaust duct whereby kitchen fumes are vented through the passage upon operation of the fan means, the improvement comprising the combination of a damper, means supporting the damper to shift between a closed position blocking the passage and an opened position allowing flow through the passage, a fluid power actuator having first and second members that move relative to one another upon the extension and retraction of the power actuator, means securing the first and second members of the power actuator between said structure and damper to provide that extension and retraction of the power actuator respectively shifts the damper between and to said positions, a source of water under pressure, a control valve between said source of water and the power actuator operable to pressurize and exhaust the latter to control the extension and retraction thereof, spray means to discharge water into the exhaust duct, a control valve between said source of water and the spray means, and an on-off control for the venting system including means to sense inadequate pressure of the source of water and responsive thereto to preclude operation of the fan means and actuation of the damper control valve to shift the damper to the opened position even upon manual actuation of the on-off control to otherwise power the venting system.

14. A kitchen venting system combination according to claim 13, further including wash control means for operating the power actuator control valve to have the damper shifted to the closed position and for operating the spray means control valve effective to discharge water from the spray means each responsive automatically to manual actuation of the on-off control for stopping the venting system.

* * * * *